United States Patent [19]

Dutcher

[11] Patent Number: 4,482,056

[45] Date of Patent: Nov. 13, 1984

[54] CARTON WITH RECESSED OPENER

[75] Inventor: Daniel P. Dutcher, Blaine, Minn.

[73] Assignee: Champion International Corporation, Stamford, Conn.

[21] Appl. No.: 495,599

[22] Filed: May 18, 1983

[51] Int. Cl.[3] ..... B65D 5/54

[52] U.S. Cl. ..... 206/611; 206/622; 206/628

[58] Field of Search ..... 206/611, 628, 633, 612, 206/622; 229/17 R

[56] References Cited

U.S. PATENT DOCUMENTS

| | | | |
|---|---|---|---|
| 3,065,896 | 11/1962 | Grapp | 206/611 |
| 3,065,897 | 11/1962 | Grapp | 206/612 |
| 3,237,842 | 3/1966 | Esse | 206/628 |
| 3,325,081 | 6/1967 | Mahon | 206/611 |
| 3,352,692 | 11/1967 | Wysocki | 206/628 |
| 3,361,332 | 1/1968 | Mason | 206/612 |
| 3,580,483 | 5/1971 | Young | 206/612 |
| 3,679,124 | 7/1972 | Schillinger | 206/628 |
| 3,835,988 | 9/1974 | Buttery | 206/608 |

*Primary Examiner*—Stephen P. Garbe

*Attorney, Agent, or Firm*—Evelyn M. Sommer; William W. Jones

[57] ABSTRACT

The carton is of the non-reclosable type which includes a portion thereof which is torn off of the remainder of the carton to open the latter. The carton is scored and folded so as to form a recessed panel at a corner of the carton, which recessed panel underlies an edge of the portion of the carton which is to be torn off. The recessed panel allows access to the edge of the tear-off portion of the carton so that the tear-off portion can be gripped. The recessed panel is bounded by at least one rectilinear score line which underlies the tear-off portion of the carton and, also, by a curvilinear score line which extends into a panel of the carton which is perpendicular to the tear-off portion of the carton.

1 Claim, 4 Drawing Figures

CARTON WITH RECESSED OPENER

This invention relates to an improved carton of the type having a tear open, non-reclosable opening feature. The carton of this invention is, more particularly, of the type which has a tear-off portion with a recessed panel disposed adjacent to one edge of the tear-off portion to facilitate gripping of the edge of the tear-off portion.

Cartons with recessed panels adjacent to edges of tear-off portions are known in the prior art. Such cartons are disclosed in U.S. Pat. No. 3,361,332, issued Jan. 2, 1968 to T. A. Mason. Such cartons have portions which are torn away from underlying portions to open the carton. The tear-away portion may be left connected to the remainder of the carton or may be completely removed from the remainder of the carton. Such cartons are generally not of the reclosable kind and their contents are usually contained in bags or pouches disposed inside of the carton. The recessed panel disclosed in U.S. Pat. No. 3,361,332 is formed by a pair of bowed score lines which meet at their opposite ends whereby the recessed panel is ovoid in configuration. The use of the pair of bowed score lines is satisfactory for some applications, but it does not limit the size of the recessed panel since the bowing of the score lines tends to cause bowing of the panels in which they are formed when the carton is erected. The more pronounced the bowing of the score line, the more likely that the panel in which such score line is formed will bow. The degree to which the edge of the tear-off panel can be undercut is also controlled by the degree to which the score line is bowed. The more pronounced the bow of the score line, the greater the edge of the tear-off panel will be undercut, and the easier the tear-off panel will be to grasp. On large panels, the degree of bowing of the score lines need not be excessive to obtain a satisfactory undercut due to the expanse of the panels, however with narrower panels the use of a pair of bowed score lines may produce a less than optimum undercut of the edge of the tear-off portion of the carton.

This invention relates to an improved carton construction for a tear-open carton wherein a recessed panel is provided to facilitate grasping of the edge of the tear-off portion of the carton. In the carton of this invention, one edge of the recessed panel is formed by a bowed score line disposed in the panel of the carton which is perpendicular to the tear-off portion of the carton. The other edge of the recessed panel is formed by a rectilinear score line disposed in a panel which underlies the tear-off portion of the carton. The ends of the rectilinear score line extend to the edges of the underlying panel and are inwardly offset from the ends of the bowed score line. The rectilinear score line can be set back into the underlying panel however far as is necessary as to provide a satisfactory undercutting of the edge of the tear-off portion of the carton so as to produce ready gripping of the edge of the tear-off portion. The rectilinear score line does not produce any tendency of the underlying panel to bow.

It is, therefore, an object of this invention to provide an improved carton of the tear-open variety which includes a recessed panel which undercuts an edge of a tear-off portion of the carton to facilitate grasping of the edge of the tear-off portion of the carton.

It is a further object of this invention to provide a carton of the character described wherein the recessed panel is bounded on one side by a bowed score line formed in a panel which is perpendicular to the tear-off portion of the carton and on the other side by a rectilinear score line which is formed in a panel which underlies the tear-off portion of the carton.

It is another object of this invention to provide a carton of the character described wherein the ends of the rectilinear score line are offset from the ends of the bowed score line.

These and other objects and advantages of the subject invention will become more readily apparent to those skilled in the art from the following detailed description of a preferred embodiment of a carton formed in accordance with this invention when taken in conjunction with the accompanying drawings in which.

Figure 1:
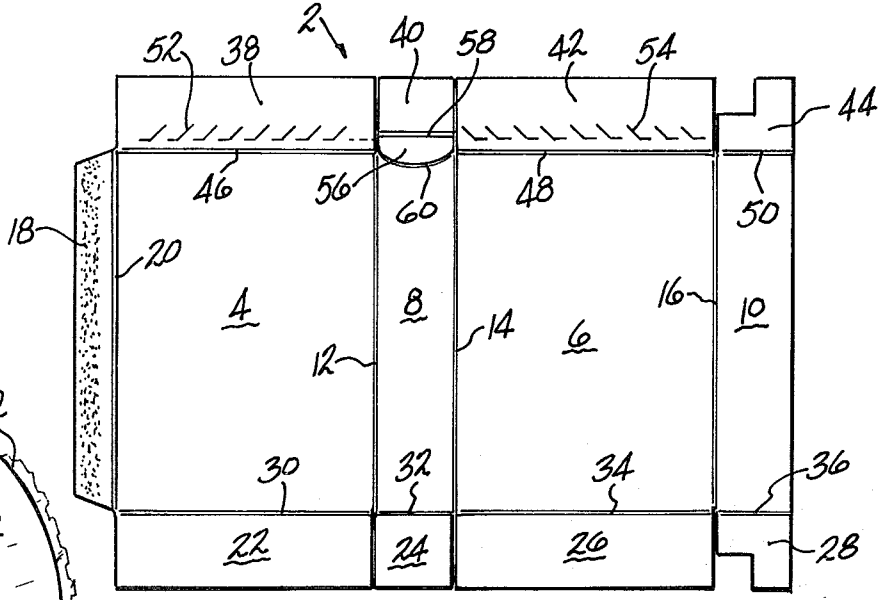
FIG. 1 is a plan view of a cut and scored blank from which a preferred embodiment of a carton formed in accordance with this invention is erected.

Referring now to the drawings, there is shown in FIG. 1 a preferred embodiment of a paperboard blank denoted generally by the numeral 2 from which the carton of this invention may be formed. The blank 2 includes a front wall panel 4, a back wall panel 6, and a pair of side wall panels 8 and 10. The side wall panel 8 is connected to the front and back wall panels 4 and 6 by fold lines 12 and 14 respectively, and the side wall panel 10 is connected to the back wall panel 6 by a fold line 16. A glue flap 18 is connected to the front wall panel 4 by a fold line 20. Bottom closure flaps 22, 24, 26 and 28 are connected to the front wall panel 4, side wall panel 8, back wall panel 6, and side wall panel 10 by fold lines 30, 32, 34 and 36 respectively. Top closure flaps 38, 42 and 44 are connected to the front wall panel 4, the back wall panel 6 and the side wall panel 10 by fold lines 46, 48 and 50 respectively. The top closure flaps 38 and 42 are each provided with a series of chevron cut scores 52 and 54 respectively. A fourth top closure flap 40 is connected to a recess panel 56 by means of a rectilinear fold line 58, and the recess panel 56 is connected to the side wall panel 8 by means of a curvilinear fold line 60.

It will be noted that the side wall panels 8 and 10 are of relatively narrow width as compared to the front and back wall panels 4 and 6 respectively. It will be noted further that the ends of the curvilinear fold line 60 are co-terminous with ends of the fold lines 46 and 12 on one hand and 48 and 14 on the other hand. The rectilinear fold line 58, however, is offset from the curvilinear fold line 60 so that the ends of the rectilinear fold line 58 are not coterminous with the ends of the curvilinear fold line 60, but rather extend to the edges of the top closure flap 40. The distance between the ends of the rectilinear fold line 58 and the ends of the curvilinear fold line 60 determines the extent to which the recess panel 56 will underlie the top closure flaps 38 and 42 when the latter are folded into overlapping closed positions. This distance can be varied depending on the degree of undercutting of the closed top flaps 38 and 42 desired. It should be noted that this variance can be obtained without changing the degree of curvature of the curvilinear fold line 60.

Figure 2:
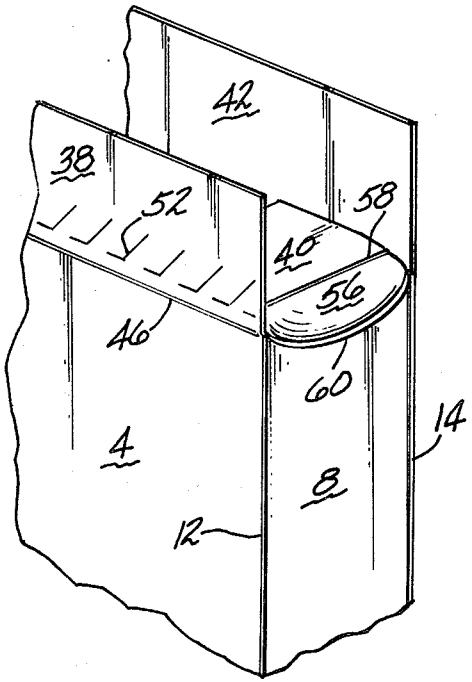
FIG. 2 is a fragmented perspective view of the corner portion of the carton prior to the carton's being closed.
Figure 3:
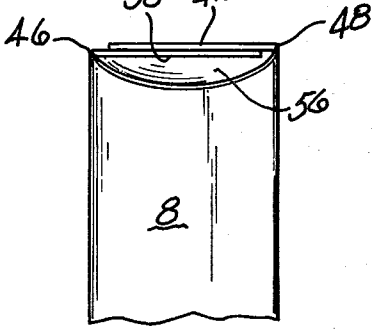
FIG. 3 is a fragmented end elevational view of the corner portion of the carton after the latter has been closed.
Figure 4:
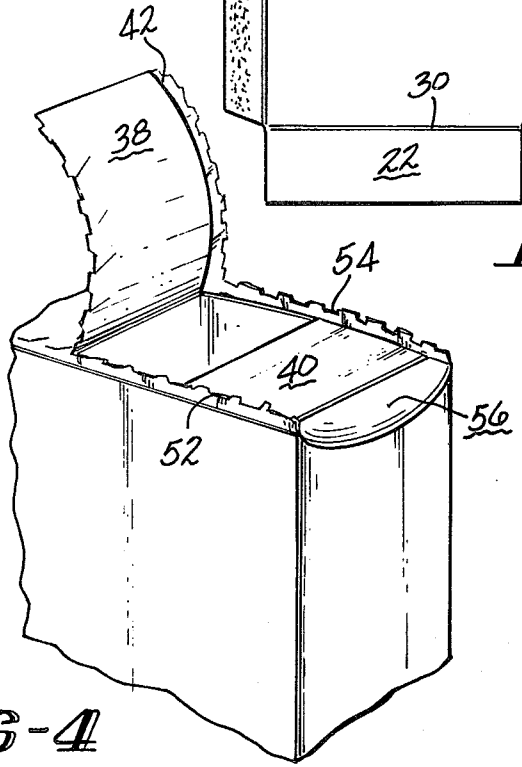
FIG. 4 is a fragmented perspective view showing the manner in which the carton is opened.

Referring now to FIG. 2, the corner of the partially erected carton which contains the recess panel 56 is shown prior to forming the top closure of the carton. The panels 4, 8 and the like have been folded about the fold line 12, 14, etc. to form the tubular shape of the carton, and the bottom flaps (not shown) have been folded and glued in place to close the bottom of the carton. After the carton is filled, the recess panel 56 is folded inwardly about the curvilinear fold line 60 and the top closure flap 40 is then folded about the rectilinear fold line 58 until the top closure flap 40 is substantially coplanar with the fold line 46. The top closure flaps 38 and 42 are then folded about the fold lines 46 and 48 into overlapping relationship as shown in FIG. 3 and glued together to close the top of the carton. It will be noted from FIGS. 2 and 3 that the panel 56 is recessed under the overlapping flaps 38 and 42 so that the latter can be manually grasped at their ends and pulled upwardly away from the remainder of the carton to concurrently rupture the cut score lines 52 and 54 as shown in FIG. 4. The top cover flaps 38 and 42 can then be torn completely away from the carton and the contents of the carton removed.

It will be appreciated that the use of the combination of the curvilinear and rectilinear fold lines to define the boundaries of the recess panel allows for variation of depth to which the recess panel underlies the top closure flaps of the carton without changing the degree of curvature of the curvilinear fold line. It will be appreciated that this improvement is particularly important where the recess panel is an extension of a relatively narrow side panel which would otherwise prohibit increasing the degree to which the recess panel underlies the tear away portion of the carton were the recess panel formed in accordance with the prior art.

Since many changes and variations of the disclosed embodiment of the inventin may be made without departing from the inventive concept, it is not intended to limit the invention otherwise than as required by the appended claims.

What is claimed is:

1. A tear open paperboard carton comprising:

(a) a front wall panel and an opposed back wall panel;

(b) opposed side wall panels foldably connected to edges of said front and back wall panels;

(c) first and second top closure flaps foldably connected to top edges of said front and back wall panels along first and second fold lines;

(d) a recess panel foldably connected to one of said side wall panels along a curvilinear fold line with the ends of said curvilinear fold line being contiguous to ends of said first and second fold lines;

(e) a rectilinear fold line defining an inner boundary of said recess panel, said rectilinear fold line extending to the edges of said recess panel with the ends of said rectilinear fold line being inwardly offset from the ends of said curvilinear fold line;

(f) a third top closure flap foldably connected to said recess panel along said rectilinear fold line;

(g) said recess panel and said third top closure flap underlying said first and second top closure flaps when the latter are folded into overlapping relationship to form a top closure for the carton; and (h) means forming parallel lines of rupture on said first and second top closure flaps whereby the latter can be torn off of the carton.

* * * * *